United States Patent [19]

Cloots

[11] 4,106,117

[45] Aug. 8, 1978

[54] APPARATUS FOR MIXING PARTICULATE MATERIAL IN A LIQUID

[75] Inventor: Henry R. Cloots, Summit, Wis.

[73] Assignee: Waukesha Foundry Company, Inc., Waukesha, Wis.

[21] Appl. No.: 776,696

[22] Filed: Mar. 11, 1977

Related U.S. Application Data

[63] Continuation-in-part of Ser. No. 684,423, May 7, 1976, abandoned.

[51] Int. Cl.[2] ..... B01F 9/18; B01F 15/02

[52] U.S. Cl. ..... 366/154; 366/172; 366/180; 366/184; 366/224

[58] Field of Search ..... 259/3, 12, 14, 15, 16, 259/29, 30, 31, 32, 33, 34; 233/3, 27, 34, 38, 40; 366/154, 172, 180, 184, 224

[56] References Cited

U.S. PATENT DOCUMENTS

| | | | |
|---|---|---|---|
| 2,186,033 | 1/1940 | Milton | 259/14 |
| 3,346,240 | 10/1967 | Lavelle | 259/26 |
| 3,892,390 | 7/1975 | Eauclaire | 259/192 |
| 3,912,231 | 10/1975 | Weber | 259/3 |
| 3,934,859 | 1/1976 | Deue | 259/14 |

*Primary Examiner*—Robert W. Jenkins

*Attorney, Agent, or Firm*—Wheeler, Morsell, House & Fuller

[57] ABSTRACT

A mixing bowl having an outwardly flared inner surface is rotated around its axis at a speed which is great enough to cause a film of liquid within the bowl to be moved upwardly by centrifugal force to the rim of the bowl. A liquid is introduced into the bottom of the bowl at a rate that permits an unbroken film of liquid to form within the bowl and move from the bottom to the rim. Particulate material is uniformly distributed in a radial direction within the bowl to contact the liquid film and mix therewith. The rim of the bowl is shaped to interact with an adjacent stationary surface to shear the liquid and particulate material mixture to increase the uniformity of the mixture. A basin is positioned around and under the rim of the mixing bowl to collect the mixture as it is thrown off the outer edge of the rim.

16 Claims, 9 Drawing Figures

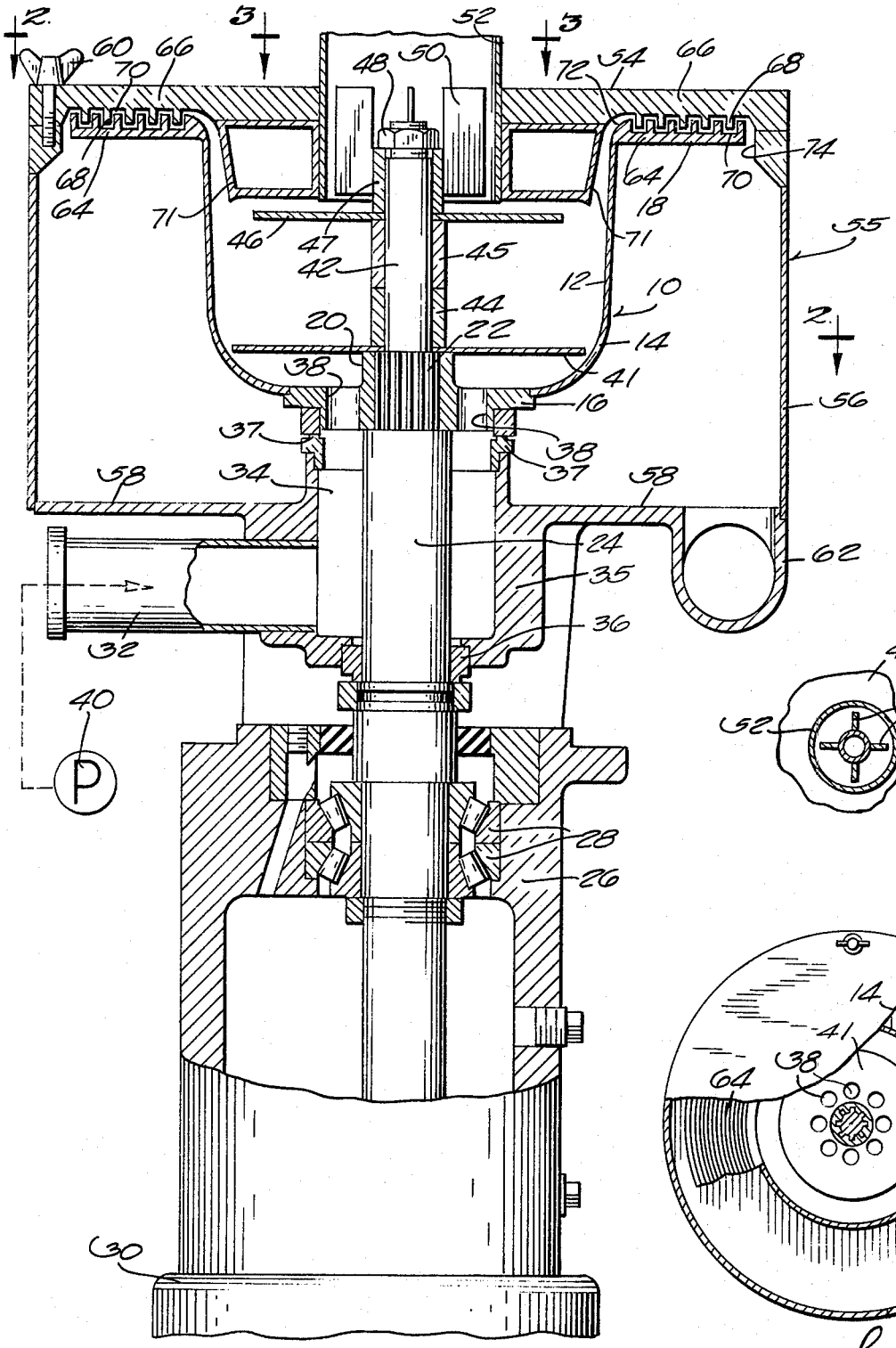
Fig. 1
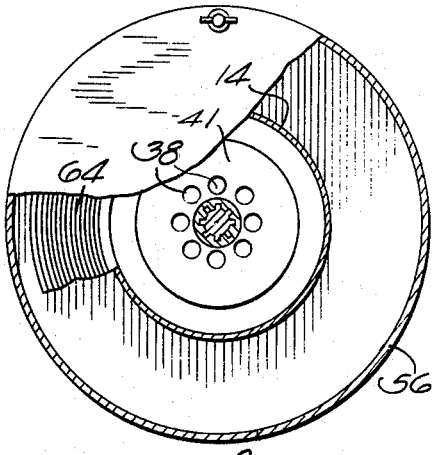
Fig. 2
Fig. 3

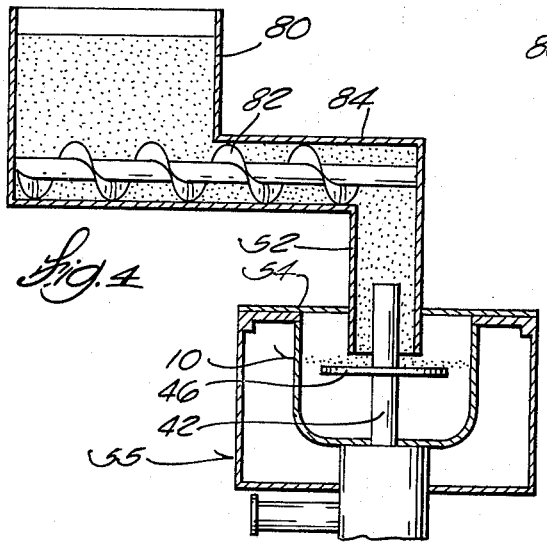
Fig. 4
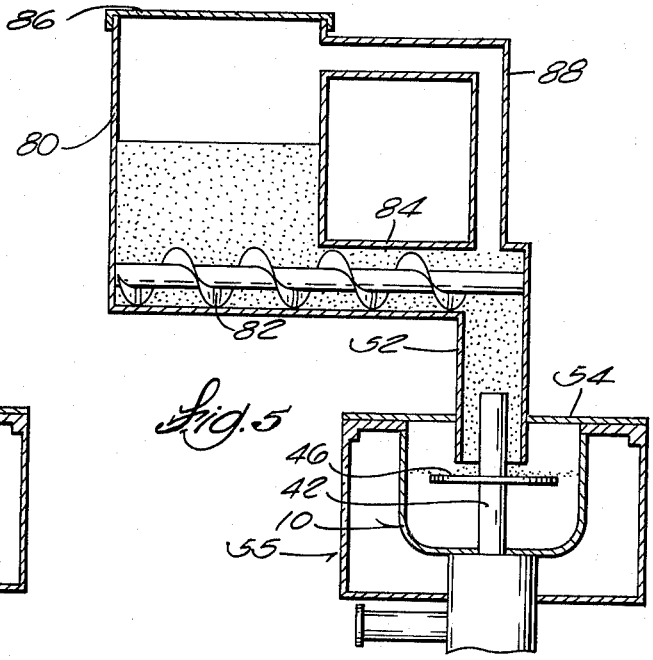
Fig. 5
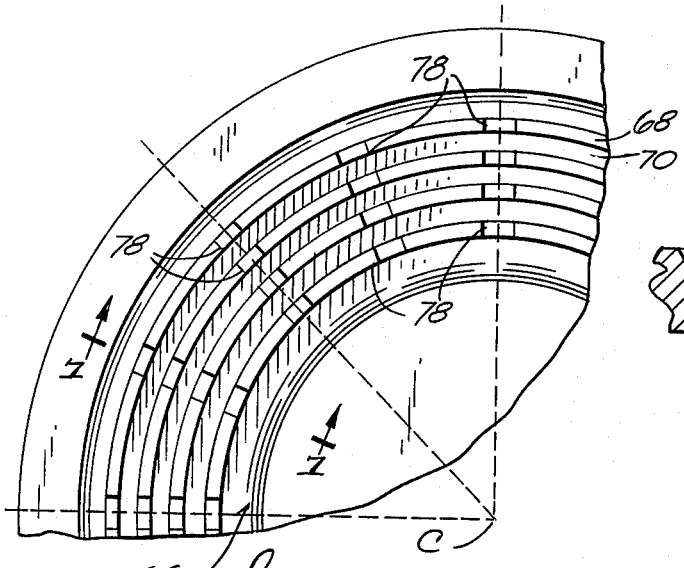
Fig. 6
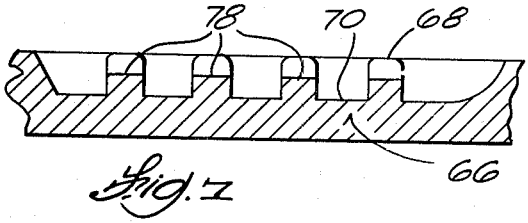
Fig. 7
Fig. 8
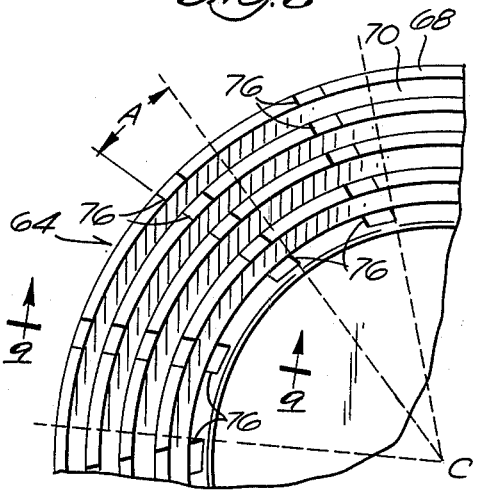
Fig. 9
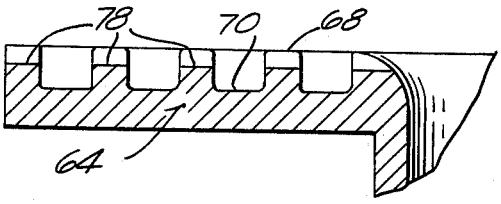

APPARATUS FOR MIXING PARTICULATE MATERIAL IN A LIQUID

This application is a continuation-in-part of Ser. No. 684,423, filed May 7, 1976, by the same inventor, now abandoned.

BACKGROUND OF THE INVENTION

This invention relates to apparatus for mixing particulate material in a liquid. In the past, particulate material and liquids were mixed together in a common vessel by means of a mechanical agitator within the vessel which stirred the mixture until it reached the desired degree of uniformity, at which time the mixture was removed from the vessel and a new charge of liquid and particulate material were introduced therein. However, this procedure is time consuming and has to be carried out in batches rather than continuously. Also, some dry particulate materials are very difficult to wet. The dry particles tend to agglomerate with each other, and the liquid contacts the outside of the agglomeration, but does not penetrate to wet the inner particles. When mixed in tanks by mechanical agitators, a long time is needed to break up these agglomerations and wet all particles.

Centrifugal mixers have been proposed in the past in which particulate material falls upon a rotating cone and is flung by centrifugal force against a film of liquid that is moving downward under the force of gravity over a stationary cone that surrounds the rotating cone. The mixture of liquid and particulate material is then passed through a rotary mixing disc having intermeshed teeth which shear the mixture and increase its uniformity. This type of mixer permits continuous mixing but is still limited as regards uniformity of mixture with particulate material that tends to agglomerate and has the additional drawback that the feed rate is determined by a gravity feed of the liquid down a cone of fixed slope and thus the feed rate cannot be conveniently adjusted without changing the thickness of the film.

SUMMARY OF THE INVENTION

The principal object of this invention is to provide an improved centrifugal mixer in which dry particulate material can be mixed with a liquid more uniformly than heretofore possible with prior art mixers.

Another object of this invention is to provide an improved centrifugal mixer which more uniformly distributes dry particulate material in a liquid to prevent formation of agglomerations of the particulate material.

An additional object of the invention is to provide an improved centrifugal mixer for liquids and dry particulate material in which the feed rate of the liquid can be continuously varied without changing the thickness of the liquid film.

Other objects, features, and advantages of the invention will be apparent from the disclosure hereof.

In accordance with this invention the foregoing objects are attained by providing (A) means for rotating a bowl about its central axis at a speed which is great enough to cause a liquid film on the inner surface of the bowl to be moved by centrifugal force up the inner surface of the bowl to the rim thereof; (B) means for introducing a liquid into the bottom of the bowl at a rate which permits the liquid to form an unbroken film on the inner surface of the bowl and move from the bottom of the bowl to the rim; (C) means for uniformly introducing dry particulate material into the film of liquid within the bowl; and (D) means for collecting the mixed particulate material and liquid at the rim of the bowl. In the preferred embodiment, the inner surface of the bowl is parabolic in shape in the zone where the dry particulate material is introduced into the liquid, and the rim of the bowl is shaped to form a shear ring which interacts with an adjacent stationary shear ring to shear the mixed liquid and particulate material to increase the uniformity of the mixture.

DESCRIPTION OF THE DRAWINGS

FIG. 1 is a longitudinal sectional view of the preferred embodiment of the invention.

FIG. 2 is a cross-sectional view taken on the line 2—2 of FIG. 1.

FIG. 3 is a fragmentary cross-sectional view taken on the line 3—3 of FIG. 1.

FIG. 4 is a diagramatic longitudinal sectional view of a dry particulate material feed system for the embodiment of FIG. 1.

FIG. 5 is a diagramatic longitudinal sectional view of an alternate dry particulate material feed system for the embodiment of FIG. 1.

FIG. 6 is a fragmentary plan view of the stationary shear ring shown in FIG. 1.

FIG. 7 is a cross-sectional view taken on the line 7—7 of FIG. 6.

FIG. 8 is a fragmentary plan view of the rotatable shear ring shown in FIG. 1.

FIG. 9 is a cross-sectional view taken on the line 9—9 of FIG. 8.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Referring to FIGS. 1 and 2, a mixing bowl 10 which has an outwardly flared inner surface 12 is formed by a stainless steel body portion 14, a stainless steel bottom portion 16, and a stainless steel rim portion 18 which are welded together to form a solid stainless steel bowl structure. The outward flare of inner surface 12 is preferable but not necessary since the invention will work with a cylindrical inner surface or an inwardly tapered surface. Bottom portion 16 has a central sleeve 20 which is splined to receive the splined portion 22 of a rotary drive shaft 24. Drive shaft 24 is rotatably mounted in a housing 26 by conventional means including bearings 28 and is rotated by drive means 30 at a speed which is great enough to cause a liquid film on the inner surface 12 of mixing bowl 10 to be moved upwardly by centrifugal force along inner surface 12 to rim portion 18.

Liquid is introduced into mixing bowl 10 from an inlet port 32 which communicates into a cylindrical chamber 34 formed by a hollow cylinder 35 below bowl 10. Cylinder 35 is supported by housing 26 and is sealed at its bottom by rotary seal 36 and at its top rotary seal 37. Liquid travels upwardly from chamber 34 through openings 38 in the bottom portion 16 of mixing bowl 10. The liquid is driven by a pump 40 which pumps the liquid at a predetermined rate which permits a unbroken liquid film to form on the inner surface 12 of mixing bowl 10 and to move from the bottom of bowl 10 to the rim 18 thereof. The rate at which liquid is introduced may be varied over a wide range depending on the desired effect. A disc 41 is clamped to the top of sleeve 20 and extends almost to the inner surface 12 of mixing bowl 10 to cause the liquid to disperse itself as a film on the inner surface 12.

Drive shaft 24 has an upwardly extending portion 42 above splined portion 22 which supports three spacer sleeve 44 and 45 and 47. A slinger disc 46 is mounted between sleeves 45 and 47. Spacer sleeve 47 is rigidly attached to shaft 42 by a nut 48 and rotates with shaft 42. Vanes 50 are attached to sleeve 47 above slinger disc 46 and project radially therefrom. A tube 52, which is supported on a bowl cover 54, surrounds vanes 50 above slinger disc 46. Vanes 50 are not essential to the invention but are preferable because they help spread the particulate material on slinger disc 46. If desired, slinger disc 46 could be rotated independent of bowl 10 from above or through a concentric lower shaft.

The length and number of sleeves 44 and 45 can be varied to adjust the position of slinger disc 46. Alternately, other suitable adjustment means can be employed.

In the operation of this embodiment, dry particulate material is fed down tube 52 and falls on slinger disc 46, which throws it by centrifugal force outwardly in a path having a component of radial motion toward the inner surface 12 of mixing bowl 10. The particulate material strikes the liquid film on inner bowl surface 12 and is entrained thereby and is carried upwardly in the moving liquid film.

In the general form of the invention, means is provided to collect the mixed liquid and particulate material as it is thrown off the rim of the rotating mixing bowl 10 due to centrifugal force. In this particular embodiment, the collecting means comprises a basin 55 which includes a hollow cylinder 56 having a bottom 58 which is supported on housing 26 and having a cover 54 which is removably supported on cylinder 56 by wing nuts 60. A tangential outlet port 62 is formed in the bottom 58 of basin 55.

In this embodiment, the rim portion 18 of mixing bowl 10 has a shear ring 64 integrally formed therewith which coacts with a stationary shear ring 66 on basin cover 54. Shear rings 64 and 66 each have a plurality of concentric circular teeth 68 which are radially separated by circular grooves 70. Grooves 70 are wider than teeth 68 to permit shear rings 64 and 66 to be meshed with a small space between opposing teeth and grooves as shown in FIG. 1 with the teeth 68 of one shear ring extending into the grooves of the other shear ring.

An annular guard ring 71 is preferably attached to basin cover 54 to prevent mixed particulate material and liquid from dropping down on top of slinger disc 46.

As mixing bowl 10 rotates, the mixture of liquid and particulate material is moved by centrifugal force up a ramp 72 on moving shear ring 64 and into the area where shear rings 64 and 66 are meshed. The separation between the meshed portions of shear rings 64 and 66 is small enough to cause shearing of the liquid and particulate material mixture therebetween which results in increased mixing and uniformity of the mixture. The sheared liquid and particulate material mixture progresses outwardly across the teeth and grooves of shear rings 64 and 66 due to centrifugal force being continuously sheared as it moves, until it is thrown off the outermost tooth 68 of rotating shear ring 64. The liquid and particulate matter mixture then strikes vertical surface 74 of basin 55 and drops down into the bottom 58 of basin 55. It will be understood that the final character of the mixture depends upon the ingredients. It may be a solution, suspension, colloid or the like.

The basic advantage of this invention is that the particulates are uniformly introduced into the liquid. The particulates tend to break up when they fall down on top of slinger disc 46 and are uniformly radially dispersed into the liquid film by centrifugal force. Each particle of dry material is separated from other particles, and each is brought into contact with a specific small quantity of liquid in the liquid film opposite slinger disc 46.

The inner surface 12 of bowl 10 is preferably parabolic in shape in the zone opposite the edge of slinger disc 46 where the particulate material is initially mixed with the liquid film. This is due to the fact that rotation of mixing bowl 10 causes the inner surface of the liquid film to tend to assume a parabolic form due to the forces of rotation and gravity and also tends to approximate the shape of the inner surface 12 of bowl 10. The parabolic shape of inner surface 13 is, however, an optional feature of the invention rather than an essential feature.

One particular advantage of the invention is that the liquid feed rate can be increased without increasing the thickness of the liquid film as was necessary in the prior art centrifugal mixer discussed previously. Increasing the rotary speed of mixing bowl 10 tends to increase the upward velocity of the liquid film which makes possible a higher feed rate without an increase in liquid film thickness. This makes possible uniform introduction of particulates at higher feed rates than has been hitherto possible.

Some mixing takes place in the liquid film on the inner surface 12 of bowl 10 due to turbulent shear in the film, and hence shear rings may not be needed for some applications of the invention. Conversely, the shear rings disclosed may not provide enough shear for other combinations, and additional shear teeth or area can be provided. The gap between shear rings can also be varied to vary the shearing. The speed of mixing bowl 10 and flow rates of the liquid and particulate material may be varied to permit better dry material control or better liquid film control.

The mixing action of shear rings 64 and 66 can be augmented by cutting radial notches 76 and 78 in teeth 68 as shown in FIGS. 6–9. Radial notches 76 and 78 each extend half way through the corresponding teeth 68, as shown in FIGS. 7 and 9. The lines of notches 78 in stationary shear ring 66 extend radially with respect to the center C (FIG. 6) of shear ring 66, but the lines of notches 76 in rotating shear ring 64 are radially skewed at an angle A (FIG. 8) with respect to adjacent radii thereof to prevent material from passing directly through the lines of notches 76 and 78 when they are substantially aligned with each other. Also, there is one less line of notches 76 then there are lines of notches 78 to prevent all the lines of notches from being aligned at the same time. Thus notches 76 and 78 agitate the mixture between shear rings 64 and 66 and increase the uniformity of mixture without allowing the mixture to move directly along the radial lines formed by notches 78. However, although notches 76 and 78 are preferable in some applications of the invention, it should be understood that they are not essential.

FIG. 4 shows one suitable feed arrangement for the dry particulate material in this embodiment of the invention. The dry particulate material is contained in a conventional hopper 80 (FIG. 4) which has a conventional feed screw 82 in its bottom that is rotatably mounted within a feed tube 84. Feed screw 82 is rotated at a predetermined speed by a conventional motor and gear train which are not shown in the drawings. Feed tube 84 is directly connected at its end to tube 52, and the dry particulate material which is formed by feed screw 82 out the end of feed tube 84 drops down tube 52 onto slinger disc 46.

Some mixtures tend to allow air to be entrained in the fluid-particulate mixture. To minimize this effect, all joints of the mixer are preferably sealed off to prevent entry of air. However, in this case, the centrifugal action of mixing bowl 10 and shear rings 64 and 66 act as an air pump which tends to create a low pressure area in the center of bowl 10, and this tends to pull dry particulate matter out of feed tube 84 faster than it is required due to the fact that there is atmospheric pressure on the top of the dry particulate material in hopper 80. To circumvent this pumping action, a sealed top 86 (FIG. 5) can be mounted on top of hopper 80 and a sealed conduit 88 can be coupled from the top of tube 52 to the top of hopper 80 above the level of the dry particulate material therein. This equalizes the pressure at the top of the particulate material and in the center of mixing bowl 10 to prevent the pumping action for the dry particulate material.

It should be understood, however, that the sealed arrangement discussed above is not essential to the invention since the problem of air entrainment does not occur in all applications of the invention, and sealing is not required where there is no air entrainment problem.

I claim:

1. Apparatus for mixing liquid and particulate matter comprising a mixing bowl having a vertical axis, means for rotating said bowl about its axis at a speed sufficient to cause a liquid therein to be moved by centrifugal force up the inner surface of the bowl to the rim thereof, means for introducing a liquid into said bowl at a rate that permits an unbroken film of liquid to form on the inner surface of the bowl, means for introducing particulate material in a path having a component of radial motion into said film of liquid and above the place where said liquid enters said bowl, and means for collecting the mixed liquid and particulate material at the rim of said bowl.

2. The apparatus of claim 1 wherein the inner surface of said mixing bowl is approximately parabolic in longitudinal sectional shape at the location where particulate material is introduced into said liquid.

3. The apparatus of claim 1 wherein said means for introducing a liquid into said bowl comprises means forming a chamber below said bowl, openings in the bottom portion of said bowl communicating into said chamber, and means for pumping said liquid into said chamber and through said openings into the bottom said bowl.

4. The apparatus of claim 1 wherein said means for introducing particulate material into said film of liquid within said bowl comprises a slinger means rotatably mounted within said bowl, means for rotating said slinger means, and means for dropping particulate material on said slinger means.

5. The apparatus of claim 4 wherein said slinger means is a slinger disc.

6. The apparatus of claim 4 and further comprising means for adjusting the vertical position of said slinger means.

7. The apparatus of claim 4 wherein said means for dropping said particulate material on said slinger means comprises a sealed hopper for containing a supply of said particulate material, a feed tube sealed to said hopper and extending from the bottom of said hopper to a position above said slinger means sealed respecting said mixing bowl, and a feed screw within a portion of said feed tube for moving said particulate material therethrough, said mixing bowl being sealed to prevent entry of air, and further comprising a sealed conduit coupled from the central portion of said bowl to said hopper at a point above the level of the particulate material therein to equalize the air pressure between the center of said bowl and the top of said hopper to prevent excess particulate material from being drawn into said bowl due to air movement.

8. The apparatus of claim 1 wherein said means for rotating said bowl comprises a drive shaft attached to the bottom portion of said bowl and means for rotating the shaft and bowl, said drive shaft extending within said bowl, said means for introducing particulate material into said film of liquid within said bowl comprising slinger means connected to said shaft within said bowl, and means for dropping particulate material on said slinger means comprising a sleeve mounted above said slinger means and means for feeding particulate material into the sleeve.

9. Apparatus for mixing liquid and particulate matter comprising a mixing bowl having a vertical axis, means for rotating said bowl about its axis at a speed sufficient to cause a liquid therein to be moved by centrifugal force up the inner surface of the bowl to the rim thereof, means for introducing a liquid into said bowl at a rate that permits an unbroken film of liquid to form on the inner surface of the bowl, means for introducing particulate material in a path having a component of radial motion into said film of liquid and above the place where said liquid enters said bowl, means for collecting the mixed liquid and particulate materials at the rim of said bowl, and further comprising a first shear ring on the rim of said mixing bowl and a coacting stationary shear ring opposite said first shear ring for shearing the mixed liquid and particulate matter to increase its uniformity.

10. Apparatus for mixing liquid and particulate matter comprising a mixing bowl having a vertical axis, means for rotating said bowl about its axis at a speed sufficient to cause a liquid therein to be moved by centrifugal force up the inner surface of the bowl to the rim thereof, means for introducing a liquid into said bowl at a rate that permits an unbroken film of liquid to form on the inner surface of the bowl, means for introducing particulate material in a path having a component of radial motion into said film of liquid and above the place where said liquid enters the bowl, means for collecting the mixed liquid and particulate material at the rim of said bowl, said means for introducing a liquid into said bowl comprising means forming a chamber below said bowl, openings in the bottom portion of said bowl communicating into said chamber, and means for pumping said liquid into said chamber and through said openings into the bottom of said bowl, said apparatus further comprising a disc supported within the bottom portion of said bowl in a position which allows the disc to assist liquid which is introduced into the bowl beneath the disc to form a film on the inner surface of the bowl above the disc.

11. Apparatus for mixing liquid and particulate matter comprising a mixing bowl having a vertical axis, means for rotating said bowl about its axis at a speed sufficient to cause a liquid therein to be moved by centrifugal force up the inner surface of the bowl to the rim thereof, means for introducing a liquid into said bowl at a rate that permits an unbroken film of liquid to form on the inner surface of the bowl, means for introducing particulate material in a path having a component of radial motion into said film of liquid and above the place where said liquid enters said bowl, means for collecting the mixed liquid and particulate material at the rim of said bowl, a first shear ring on the rim of said mixing bowl and a coacting stationary shear ring opposite said first shear ring for shearing the mixed liquid and particulate matter to increase its uniformity, and a stationary cover plate mounted over said mixing bowl, said stationary shear ring being on said cover plate.

12. The apparatus of claim 11 and also comprising a guard ring attached to said cover plate and extending downwardly therefrom over said slinger means to prevent mixed fluid and particulate material from dropping down on said slinger means.

13. Apparatus for mixing liquid and particulate matter comprising a mixing bowl having a vertical axis, means for rotating said bowl about its axis at a speed sufficient to cause a liquid therein to be moved by centrifugal force up the inner surface of the bowl to the rim thereof, means for introducing a liquid into said bowl at a rate that permits an unbroken film of liquid to form on the inner surface of the bowl, means for introducing particulate material in a path having a component of radial motion into said film of liquid and above the place where said liquid enters said bowl, means for collecting the mixed liquid and particulate material at the rim of said bowl, and a first shear ring on the rim of said mixing bowl and a coacting stationary shear ring opposite said first shear ring for shearing the mixed liquid and particulate matter to increase its uniformity, each shear ring containing circular teeth which are separated by circular grooves.

14. The apparatus of claim 13 and further comprising circumferentially spaced radial notches in the teeth of both shear rings for increasing the mixing action of said shear rings.

15. The apparatus of claim 13 wherein said notches in the teeth of both shear rings are arranged in radially extending lines, the lines of notches on one shear plate being skewed with respect to the lines of notches on the other shear plate to prevent the mixed fluid and particulate material from flowing in a straight line down said lines of notches when they are substantially aligned.

16. The apparatus of claim 15 wherein there is at least one less line of notches on one shear plate than on the other to prevent all of the lines of notches from being simultaneously substantially aligned at the same time.

* * * * *